United States Patent [19]

LautenschlMUL/a/ ger

[11] 4,207,652

[45] Jun. 17, 1980

[54] MOUNTING ELEMENT FOR FURNITURE HINGES

[75] Inventor: Horst LautenschlMUL/a/ ger, Reinheim, Fed. Rep. of Germany

[73] Assignee: Mepla Inc., High Point, N.C.

[21] Appl. No.: 928,776

[22] Filed: Jul. 28, 1978

[51] Int. Cl.[2] ..... E05D 7/04
[52] U.S. Cl. ..... 16/130
[58] Field of Search ..... 16/129, 130, 131

[56] References Cited

U.S. PATENT DOCUMENTS

| | | | |
|---|---|---|---|
| 375,038 | 12/1887 | Wright | 16/131 |
| 3,323,163 | 6/1967 | Goodnow | 16/129 |
| 4,007,513 | 2/1977 | Zernig | 16/129 X |
| 4,099,293 | 7/1978 | Pittasch | 16/149 |

FOREIGN PATENT DOCUMENTS

| | | | |
|---|---|---|---|
| 2554133 | 6/1977 | Fed. Rep. of Germany | 16/129 |
| 1759642 | 9/1977 | Fed. Rep. of Germany | 16/131 |
| 2649047 | 5/1978 | Fed. Rep. of Germany | 16/130 |

*Primary Examiner*—Wm. Carter Reynolds

[57] ABSTRACT

A mounting element for the adjustable fastening of an elongated supporting arm which is the carcass-related part of an articulated hinge, for the pivoting articulation of a door leaf or flap on the carcass of a furniture piece whose carcass bears on its open front facing the door leaf or flap a frame projecting inwardly from the carcass walls. The carcass frame has adjacent each of the mounting elements to be fastened to it, a recess open towards its inner frame edge, in which the mounting element is disposed, and the mounting element has a mounting plate, which is made in one piece with a mounting body which can be inserted matingly into the frame recess and can be fastened to the frame.

11 Claims, 9 Drawing Figures

FIG. 3
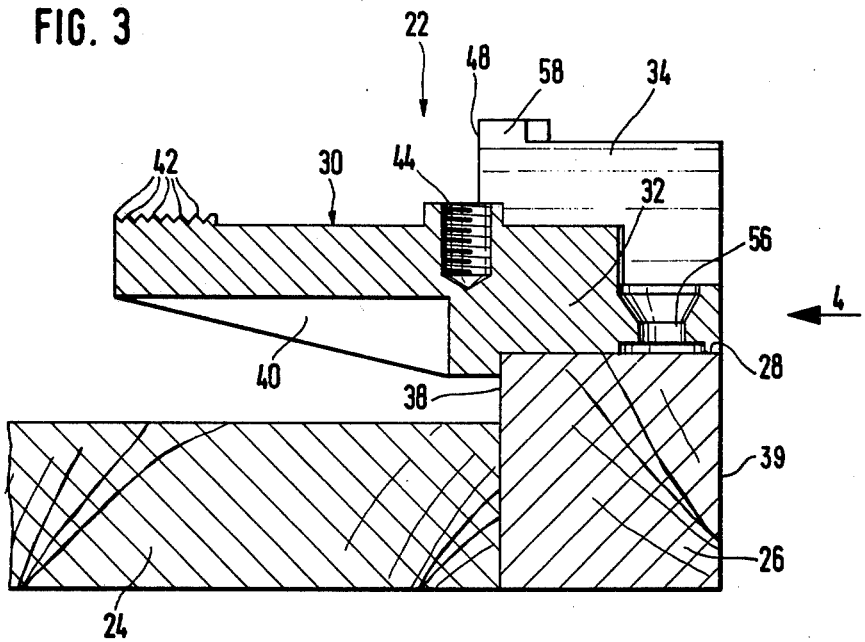
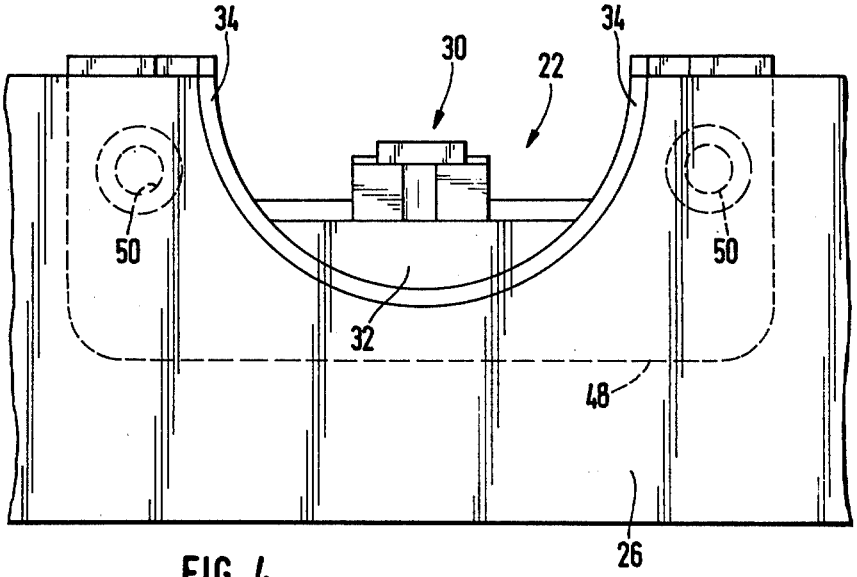
FIG. 4

MOUNTING ELEMENT FOR FURNITURE HINGES

BACKGROUND

The invention relates to a mounting element for the adjustable fastening of the carcass-related part, in the form of an elongated supporting arm, of an articulated hinge for the mounting of a door leaf or of a flap door on the carcass of a furniture piece whose carcass bears, on its door-leaf or flap-door side a facing frame which projects inwardly into the door opening at right angles to the carcass walls.

The supporting arm of such articulated hinges, which may be in the form of four-joint hinges or crosslink hinges, is fastened, in the case of furniture pieces having no facing frame, to an elongated mounting plate, the supporting arm being fitted over the mounting plate and being able to be fixed adjustably at different positions along the length of the mounting plate. The mounting plate is normally fastened to the inside surface of a cabinet sidewall or supporting wall. This is not possible, however, in the case of cabinets of the kind involved herein, which have on the door side a facing frame attached at right angles to the carcass walls and reducing the size of the door opening. Such cabinets, however, are widely marketed, chiefly as kitchen cabinets, and they have hitherto been equipped with the well-known conventional single-joint hinges for the attachment of the doors, the joint of these hinges being externally visible on the front of the facing frame adjacent the door.

Since it is desirable also to attach doors to such cabinets with a hinge which is invisible when they are closed, the attempt is made to equip the doors of such cabinets with modern articulated hinges, and it would be advantageous, for the avoidance of unnecessary redesigning and also for reasons of cost, if such hinges could be used without any special adaptation. This is not easily possible, however, because for this purpose the mounting plate would have to be disposed at a considerable distance inwardly from the cabinet sidewall or supporting wall on account of the inward projection of the facing frame, so as to provide room for the peculiar movement of articulated hinges. Mounting the hinges on the frame itself, however, appears difficult, because these frames have a relatively small thickness, so that the elongated mounting plate commonly used in the known articulated hinges cannot easily be fastened with sufficient stability to the edge of the facing frame of the cabinet.

THE INVENTION

It is the object of the invention to further develop the mounting element used for the adjustable mounting of the carcass-related supporting arm of the known articulated hinges into one which will make it possible to mount the known articulated hinges without modification, on the above-described cabinets having facing frames. On the other hand apertures can also be provided in the fastening flanges through which screws can be driven into the frame. In this case the fastening flange serves simultaneously for holding the mounting element on the frame.

Additionally, or alternatively, the mounting body can be provided with at least one bore for a screw which can be driven into the surface defining the recess.

The locating or fastening flanges can be disposed on the mounting body and on its lateral portions such that, when the mounting element is properly installed, they will engage the back of the frame facing the interior of the furniture piece. In this manner the fastening position of the mounting element is clearly defined with respect to the back of the facing frame.

Alternatively, the locating or fastening flanges can be joined to the lateral portions of the mounting body such that, when properly installed, they will engage the frame edge defining the door opening. The flanges therefore will laterally project from the extremities of the extensions of the mounting body in the manner of a flap or wing.

In this case it is recommendable that the openings in the fastening flanges for the fastening screws be made in the form of elongated holes disposed parallel with the mounting plate, since the mounting body can then be fastened to the frame so as to be adjustable to some degree in the direction of the depth of the furniture piece. On account of this adjustability, the mounting element thus constructed will then be suitable for frames of different thickness.

The above-mentioned mounting element with wing-like, projecting connecting flanges resting on the front edge of the frame may be developed further so that an additional, thin, plate-like a butting flange is arranged at the mounting body or its extensions such that it rests in the proper mounting position at the front side of the frame. The additional flange thus covers possible gaps between the mounting element and the recess in the frame and guarantees a definite fastening position of the mounting element with respect to the front of the frame.

The gap between the mounting element and the recess in the frame covered by the additional flange may be selected larger deliberately in order to make the mounting element adjustable as to height within a certain range, that is in order to adjust the height of the door in a direction parallel to the pivot axis of the hinge. In this case, the openings for the connecting screws provided in the connecting flanges resting against the front edge of the frame are designed as oblong holes extending perpendicularly to the longitudinal extension of the mounting plate in order to permit an adjustment of the mounting element in the desired direction after loosening of the connecting screws.

The notch or recess in the door frame, as seen from the open front of the cabinet, is approximately semicircular in shape, so that the bearing surfaces of the mounting body facing the notch or recess, and those of its extension, are of complementary arcuate shape.

Since such an arcuate shape of the engaging surfaces of the mounting element and recess would permit the mounting element to be installed crookedly if its fastening flanges were to engage only the back side of the frame, it is recommendable in this case to have the locating or fastening flange project slightly beyond the edge of the frame alongside the recess in the frame, and to provide lugs engaging the edge of the frame and projecting in the direction of the door in the areas projecting beyond the edge. These lugs would reliably prevent the mounting element from being installed crookedly.

The invention will be further explained in the following description of several embodiments, in conjunction with the drawing wherein:

FIG. 3 is a cross-sectional view taken in the direction of the arrows 3—3 of FIG. 2;

FIG. 4 is a front elevational view of the mounting element of the invention, taken in the direction of the arrow 4 of FIG. 3;

Figure 1:
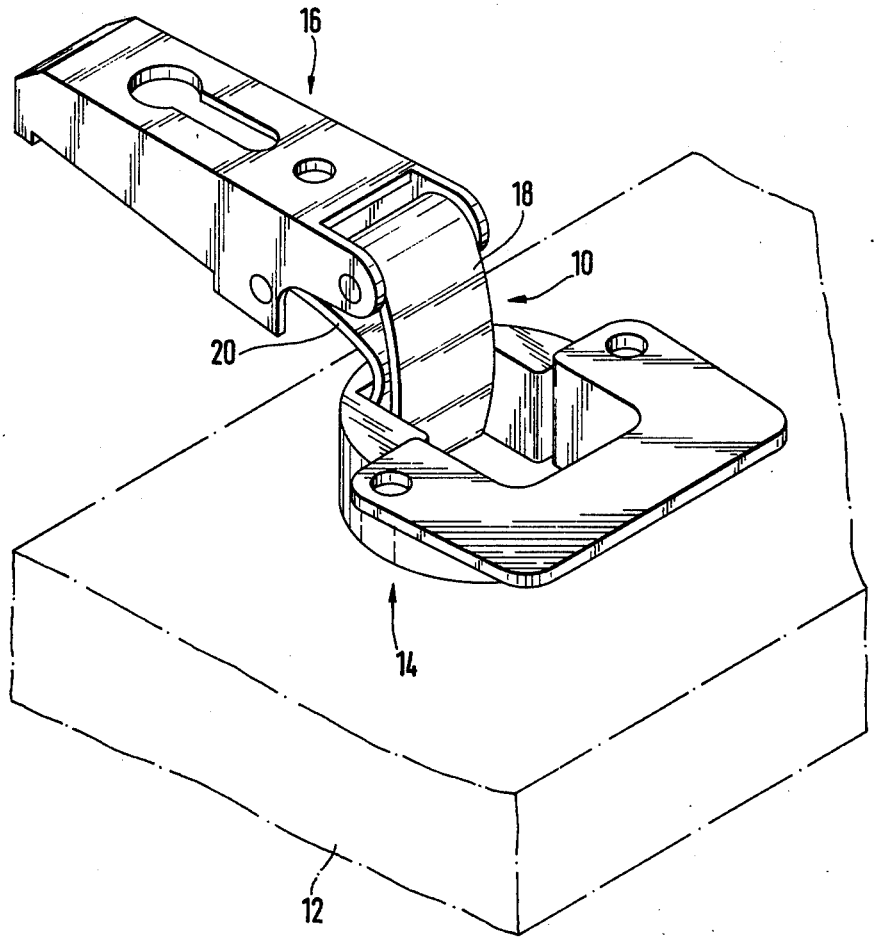
FIG. 1 PRIOR ART
FIG. 1 is a perspective view of a known four-joint hinge which is to be fastened by means of the mounting element of the invention to a door frame attached as a facing to the carcass walls of a piece of furniture.

The hinge 10 represented in FIG. 1 is a four-joint hinge which can serve as an example of the kind of hinges which are to be attached by means of the mounting elements of the invention to be described herein to a door frame attached as a facing to a cabinet carcass. The hinge 10 is composed of the cup-like door part 14 which can be flush-mounted in a mortise in a door leaf 12, and the carcass part of the hinge which is in the form of an elongated support arm 16, these being joined together by two hinge links 18 and 20 pivotally attached at their extremities to the hinge parts 14 and 16, respectively. The invention, however, is not restricted to the four-link hinge illustrated, and it can be used for articulated hinges quite generally, including, for example, the known crosslink hinges enabling the door leaf to open 180°.

Figure 2:
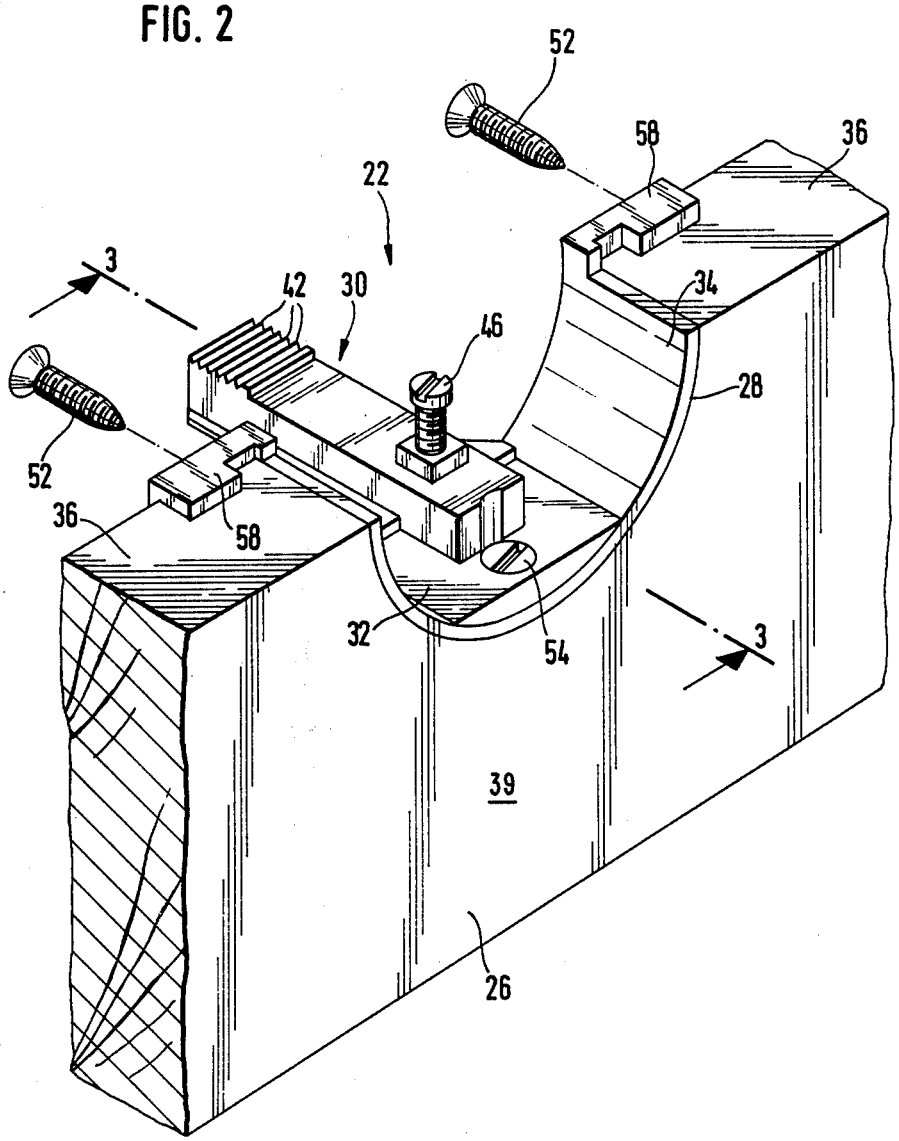
FIG. 2 is a perspective view of a first embodiment of the mounting element of the invention, whereby the hinge can be fastened to the door frame in accordance with FIG. 1.

A first embodiment of a mounting element 22 of the invention, whereby the hinge 10 can be affixed to a frame 26 attached as a facing extending at an angle with respect to a wall 24 of the carcass of the furniture piece, for example the side wall of a kitchen cabinet, is shown in FIGS. 2 to 4. The mounting element is disposed in an approximately semicircular notch or recess 28 which extends in the edge of frame 26 toward the carcass wall 24. The mounting element is composed of a mounting plate 30 corresponding to the known mounting plate which is usually fastened directly to a carcass wall, and a mounting body 32 cast in one piece with the mounting plate, whose outer surface facing the notch 28 is of an arcuate shape corresponding to the radius of the notch and merges with the extensions 34 which are likewise of an arcuate configuration.

The length of the extensions 34 is selected such that their free ends will be flush with the inner edge 36 of the frame 26. It is apparent that the mounting plate 30 is situated below the edge 36 of the frame, within the notch 28. The mounting plate has the conventional elongated shape which fits within the supporting arm 16 of hinge 10, and therefore it projects into the interior of the carcass beyond the interior or rear face 38 of frame 26, which frame also has a front face 39. A tapered rib 40 (FIG. 3) on the underside of the mounting plate reinforces the mounting plate and joins it to the mounting body 32 to form a rigid unit. In its rear end portion the mounting plate has the conventional teeth 42 for the fixation of the inner end of the supporting arm 16 of hinge 10, while a set screw 46 is threaded into a tapped bore 44 in its front portion, and fixes the supporting arm 16 on the mounting plate 30.

The inner ends of the flanking portions 34 and of the mounting body 32 adjoin a transversely disposed and laterally extending locating and fastening flange 48 as part of the same casting, which, when the mounting element 22 is properly installed, engages the back face 38 of the frame 26. The bores 50 in this flange 48 enable the mounting element 22 to be screwed to the frame 26 by means of screws 52 which are driven in from the back of the frame. Additional fixation of the mounting element in the notch 28 is accomplished by means of a screw 54 which can be driven through a bore 56 (FIG. 3) through the mounting body 32 into the surface of the notch 28. To prevent the mounting element from being inserted crookedly in the notch, the locating or fastening flange 48 is raised slightly above the frame edge 36 adjacent the notch therein, and short lugs 58 are provided in the portion projecting above the edge, which engage the edge of the frame. The position of the mounting element 22 is therefore precisely determined by the locating and fastening flange 48 and by the lugs 58.

Figure 5:
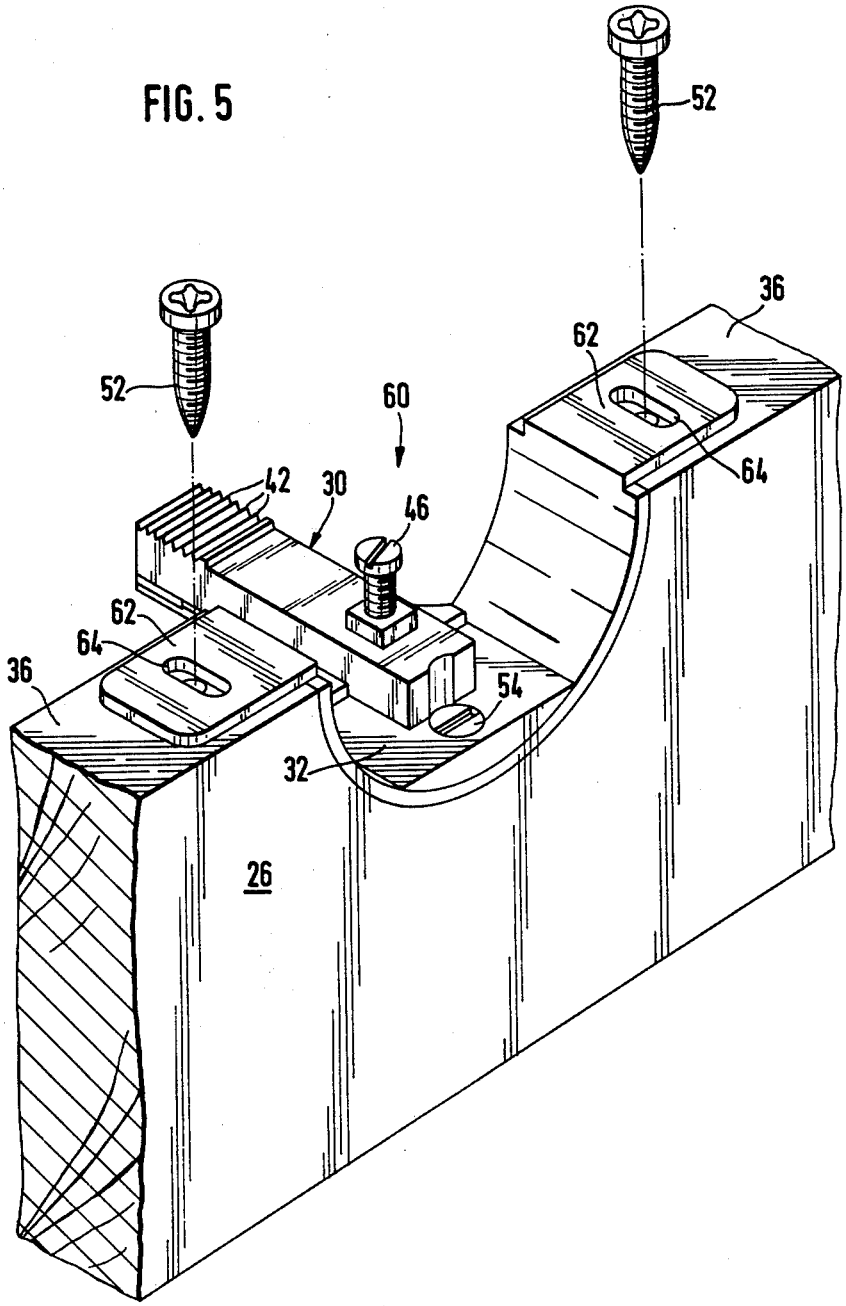
FIG. 5 is a perspective view of a second embodiment of the mounting element of the invention.

The mounting element shown in FIG. 5 is largely the same as the mounting element 22 described before, and identical parts in the drawing are given the same reference numbers, so that insofar as the similarity of the design is concerned, it will suffice to refer to the preceding description. In contradistinction to mounting element 22, however, no transverse flange is provided corresponding to the locating and fastening flange 48; instead, at each of the free ends of the extensions 34 there is provided a flat locating and fastening flange 62 such that, when the mounting element 60 is properly installed in the notch 28, the bottoms of these flanges 62 will lie upon the frame edge 36. Elongated holes 64 in these flanges 62 enable the mounting element 60 to be fastened in a variety of positions relative to frame 26 within the length of the elongated holes 64. The mounting element is therefore especially suitable for frames of different thicknesses.

Figure 6:
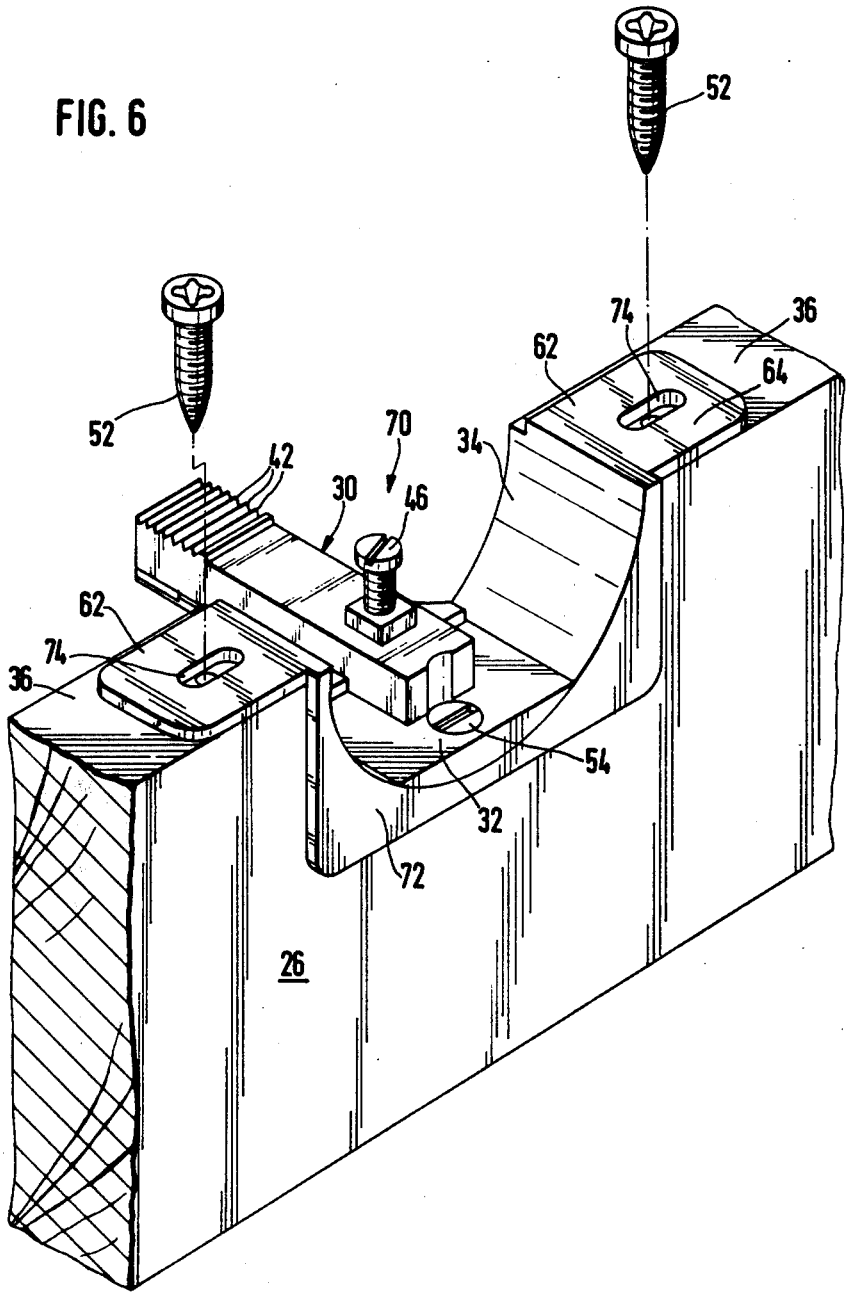
FIG. 6 is a view similar to FIGS. 2 and 5 of a third embodiment of the mounting element of the invention.

FIG. 6 shows a mounting element 70 which can be considered as a variant of the previously described mounting element 60 to the extent that it, too, is provided with fastening flanges 62 lying against the edge 36 of the frame. In addition, however, the mounting element 70 has a thin, flat locating flange 72 engaging the front of the frame. In this manner the position of the mounting element 70 is determined with respect to the front of the frame. Since the front of the frame is the reference surface for the door to be mounted, the mounting element 70 is thus suitable for frames of any thickness. Furthermore, the locating flange 72 also serves to conceal any gaps between the mounting body 32 or its extensions 34 and a notch which is not fashioned so as to fit it precisely.

In certain cases, the notch in the frame can also be intentionally made slightly oversize in order to permit some degree of displacement of the mounting element parallel to the pivot axis of a hinge. In this case the fastening holes in the flanges 62 are in the form of elongated holes, as in the case of the mounting element 60, so as to provide for vertical adjustability of the door. The elongated holes 74, however, extend in the desired direction of adjustment, i.e., they are at right angles to the elongated holes 64 of mounting element 60. The space required between the walls of the notch and the mounting body for such vertical adjustability is concealed by the locating flange 72. The thickness of the locating flange 72 is intentionally kept small, in order to reduce the clearance between the face of the frame and the back of the door to be mounted thereon.

Figure 7:
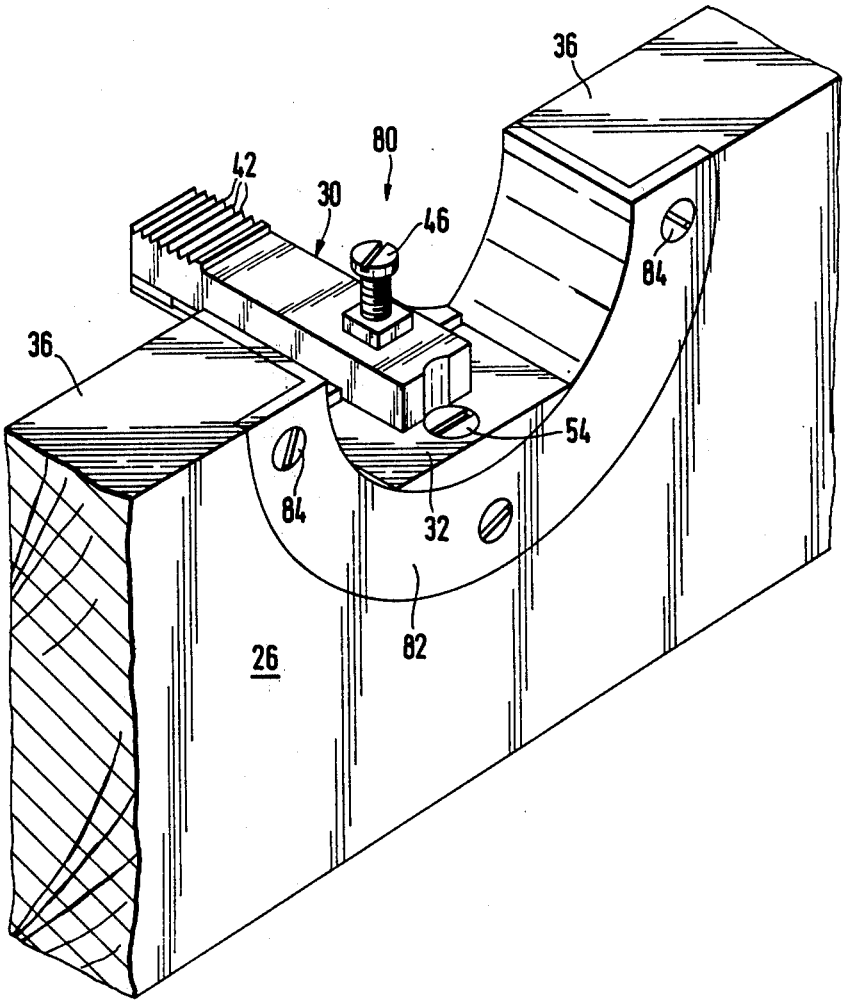
FIG. 7 is a perspective representation of a fourth embodiment.
Figure 8:
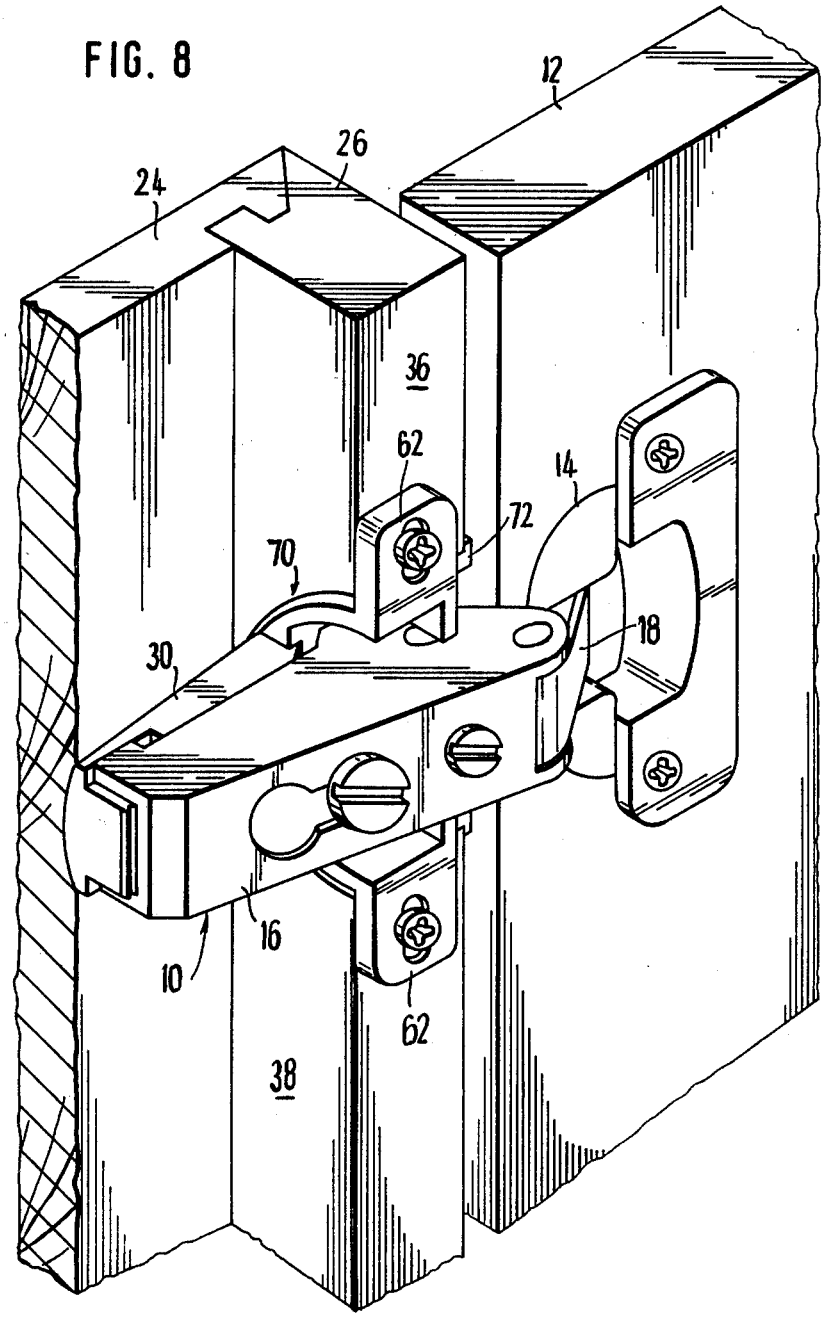
FIGS. 8 and 9 are perspective views of the combination of a part of a piece of furniture, a door, a hinge and the mounting element according to FIG. 6, with the door in open and closed position, respectively.
Figure 9:
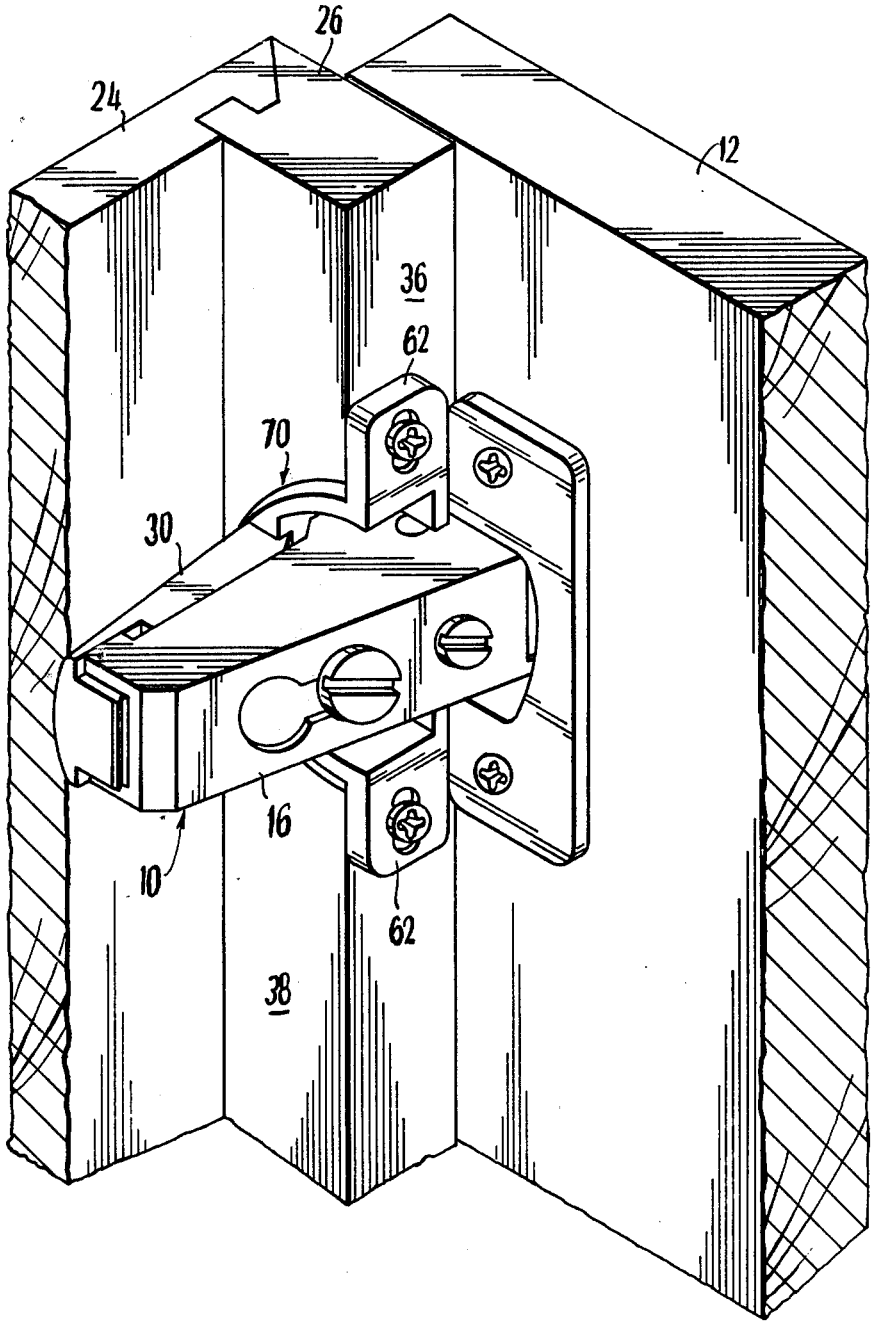

If the above-mentioned clearance between the face of the frame and the door is not desired, and on the other hand the face of the frame is to be the reference surface for the installation of the mounting element, the additional embodiment shown in FIG. 7 has been developed, of a mounting element 80 which has a locating and fastening flange 82 engaging the front face of the frame 26, and which is semicircular like the notch provided in the frame. This semicircular configuration makes it possible to produce the notch in the frame by means of a stepped boring tool such that the locating and fastening flange will be able to be sunk into the frame to a depth corresponding to its thickness. The front face of the flange 82, therefore, will be flush with the front face of frame 26 and, when the supporting arm of the hinge is correctly adjusted on the mounting plate 30 there will be no gap between the face of the frame and the back of the door to be mounted thereon.

The fastening of the mounting element 80 is accomplished properly by means of screws 84 passing through holes in flange 82 and set with heads flush with the surface thereof.

It is apparent that the mounting element of the invention can be modified or further developed within the scope of the concept of the invention. Thus, the mounting element can also be designed for installation in frame recesses other than the semicircular notches of the embodiments described hereinabove, such as for example rectangular mortises; the mounting bodies and their extensions will then be of a corresponding configuration. The mounting elements of the invention are preferably made by the die-casting method from zinc (Zamak), but they can also be made of other suitable metals. Also, it is not essential to make the mounting elements in one piece, since it is alternatively also possible to make the mounting body together, if desired, when the extensions, as one piece and the mounting plate as a separate piece, and to join them together in some appropriate manner. The mounting plates can be modified for adaptation to supporting wall hinge parts of other configuration. In particular, it is also possible to construct mounting plates in which provision is made for an additional adjustment of the hinge in the direction of the pivot axis of the hinge.

We claim:

1. In combination:

a piece of furniture having a carcass wall and a frame connected to the carcass wall and extending at an angle with respect to the carcass wall;

said frame having a front face, a rear face substantially parallel to said front face, and an inner frame edge extending substantially perpendicular to said faces and spaced from said wall;

said face defining a recess extending from said inner frame edge towards said carcass wall and from said front face to and through said rear face;

a mounting plate for supporting part of an articulated hinge for connecting a door to said piece of furniture, which door is to cover part of said frame between said frame edge and said carcass wall said mounting plate extending from within said recess substantially parallel to said frame edge and spaced from said carcass wall and beyond said rear face;

a mounting body connected to said mounting plate and located in said recess;

and means for connecting said mounting body to said frame.

2. The combination according to claim 1, wherein said mounting body has an outer surface substantially conforming to said recess, and also has locating and/or fastening flanges for engagement with said frame edge adjacent said recess.

3. The combination according to claim 2, wherein openings are provided in the locating and/or fastening flanges, and wherein said connecting means are fastening screws extending through said openings into the frame edge beneath said flanges.

4. The combination according to claim 1, wherein said mounting body is provided with at least one bore for a fastening screw to be driven into said frame in said recess.

5. The combination according to claim 3, wherein the openings provided in the fastening flanges for the fastening screws are in the form of elongated holes extending parallel to the mounting plate.

6. The combination according to claim 2, comprising a locating flange disposed on said mounting body and covering part of the front face of the frame.

7. The combination according to claim 3, wherein said mounting plate has a longitudinal axis and the openings provided in the fastening flanges are in the form of elongated holes having their major extension at right angles to said longitudinal axis of the mounting plate.

8. The combination according to any one of claim 1 to 7, wherein said recess in the frame is approximately semicircular when looking at said front face.

9. The combination according to claim 2, wherein said locating and fastening flange is disposed on the mounting body and engages said front face, said locating and fastening flange being semicircular as seen in a direction perpendicular thereto and concentrically with respect to the edge of the recess.

10. The combination according to claim 2, wherein said locating and/or fastening flanges are so disposed on the mounting body that they engage the rear face of the frame.

11. The combination according to claim 10, wherein said locating and/or fastening flanges project slightly beyond the edge of the frame adjacent the recess, and locating lugs projecting toward said front face and engaging said edge on either side of the recess.

* * * * *

UNITED STATES PATENT AND TRADEMARK OFFICE

CERTIFICATE OF CORRECTION

PATENT NO. : 4,207,652

DATED : June 17, 1980

INVENTOR(S) : HORST LAUTENSCHLÄGER

It is certified that error appears in the above–identified patent and that said Letters Patent are hereby corrected as shown below:

Under "UNITED STATES PATENT" [19] and in item [75] change "LautenschlMUL/a/ger" to --Lautenschläger--;

Column 6, Line 1, change "face" to --frame--;

Line 41, change "claim" to --claims--.

Signed and Sealed this

*Nineteenth* Day of *August 1980*

[SEAL]

*Attest:*

SIDNEY A. DIAMOND

*Attesting Officer*

*Commissioner of Patents and Trademar*